United States Patent [19]

Lux

[11] 4,303,175

[45] Dec. 1, 1981

[54] OVERCAP ASSEMBLY FOR VALVED CONTAINERS

[75] Inventor: William J. Lux, Holland, Pa.

[73] Assignee: Philmac Corporation, Philadelphia, Pa.

[21] Appl. No.: 144,350

[22] Filed: Apr. 28, 1980

[51] Int. Cl.[3] ..... B65D 41/04; B67D 5/32

[52] U.S. Cl. ..... 220/288; 220/281; 220/85 P; 222/153; 222/182

[58] Field of Search ..... 220/281, 288, 85 P; 222/153, 182

[56] References Cited

U.S. PATENT DOCUMENTS

| | | | |
|---|---|---|---|
| 624,004 | 5/1899 | Filteau . | |
| 2,949,205 | 8/1960 | Fitz . | |
| 2,961,128 | 11/1960 | Cochran . | |
| 2,964,207 | 12/1960 | Towns . | |
| 3,341,044 | 9/1967 | Valk . | |
| 3,462,045 | 8/1969 | Markowitz . | |
| 3,595,427 | 7/1971 | Markowitz . | |
| 3,706,401 | 12/1972 | Gach | 220/85 P |
| 3,729,120 | 4/1973 | Sette | 222/182 |
| 3,738,536 | 6/1973 | Gach . | |
| 3,747,807 | 7/1973 | Gach . | |
| 3,854,622 | 12/1974 | McKirnan . | |
| 3,863,814 | 2/1975 | Shelton | 222/182 |
| 3,934,751 | 1/1976 | Green . | |

*Primary Examiner*—George E. Lowrance
*Attorney, Agent, or Firm*—Howson and Howson

[57] ABSTRACT

An overcap assembly which is particularly suited for use in conjunction with spray-type cans having domed upper ends with annular beads surrounding a valve actuator. The overcap assembly includes a molded-plastic cup-shaped member adapted to be placed over the valve and an inverted, frusto-conical sleeve connecting the cap to the can in such a manner as to expose the valve when the cap is rotated. The sleeve has a pair of legs connected together by flexible webs providing fulcrums at diametrical locations. Lugs are provided on the lower ends of the legs to engage underneath the bead, and a helical groove is provided in the upper end of the sleeve. A cylindrical wall depends from the end wall of the cap and has a bead which engages in the helical groove. The webs of the sleeve are located closer to the top the cap than to the lugs at the bottom. As a result, rotation of the cap relative to the sleeve causes the upper end of the sleeve to be squeezed inwardly about the fulcrums, thereby displacing the lugs outwardly away from the bead on the can. By designing the assembly so that the friction between the sleeve and the can is less than the friction between tne sleeve and the cap, a child-proof function can be provided by requiring a combined turning and pulling action to expose the valve.

10 Claims, 3 Drawing Figures

OVERCAP ASSEMBLY FOR VALVED CONTAINERS

FIELD OF THE INVENTION

The present invention relates to container closures, and more particularly, the present invention relates to overcap assemblies for aerosol-type spray containers.

BACKGROUND OF THE INVENTION

Aerosol cans have been used for quite some time to contain various sprayable liquids, including paint, disinfectants, insecticides, etc. In order to protect the valves on such containers during shipment and, in some instances to provide a child-proof function, various types of overcap assemblies have developed.

For instance, U.S. Pat. No. 3,863,814 discloses an overcap assembly which includes an outer cover portion and a centrally located series of depending legs which are urged into engagement with the underside of an aerosol container bead by means of an annular collar. The collar is adapted, when pushed downwardly, to urge the legs inwardly into engagement with the bead surrounding the valve. The outer portion of the overcap is suitably notched to cooperate with the lugs on the collar to effect a locking action.

U.S. Pat. Nos. 3,773,227 and 3,934,751 both disclose aerosol container overcaps having slotted interior legs which normally engage below the bead around the valve but which, upon application of central downward pressure on the cap, disengage the bead to afford removal of the cap from the container.

U.S. Pat. No. 3,854,622 discloses an aerosol container overcap assembly having a slotted internal cylindrical wall which terminates in lugs engaging the underside of the bead surrounding the valve. The slots are so arranged relative to the lugs and outer cover as to afford disengagement when the outer cover is squeezed inwardly.

U.S. Pat. Nos. 3,738,536 and 3,747,807 both disclose child-proof overcaps for aerosol containers which require a combined axial and rotary motion to disengage the overcap from the container.

U.S. Pat. Nos. 3,462,045 and 3,595,427 both disclose overcap assemblies comprising two pieces: one piece being fastened on the container by being rotatable relative thereto, and the other piece being an overcap which threads on to the first-mentioned piece. The container-mounted piece is gripped with one hand and the overcap is gripped and rotated with the other hand to open the container.

U.S. Pat. No. 2,961,128 discloses a snap-on type of overcap for an aerosol can. The overcap has an interior depending slotted wall with projections which releasably engage the inside of the bead surrounding the valve. The cover is installed and removed simply by moving it axially relative to the container.

U.S. Pat. No. 3,341,044 discloses a safety cap assembly for a bottle having a bead around its open upper end. The cap assembly includes a closure having a depending slotted skirt with internal lugs designed to engage underneath the bead of the bottle when pressed inwardly. Inward pressure is applied by means of an overcap assembly having internal threads which engage external threads on a frusto-conical portion of the closure. When the overcap assembly is pressed and turned, the desired motion of the lugs is effected.

U.S. Pat. Nos. 2,949,205 and 2,964,207 both disclose closures requiring combined rotary and axial motion to disengage a cap from a container.

U.S. Pat. No. 624,004 discloses an old press-on, screw-off type of container closure.

Other known container overcaps require separate tools such as screwdrivers to pry off the overcap to expose valve.

While each of the aforementioned types of overcap assemblies may function satisfactorily for its intended purpose, there is an ever-present demand for an overcap assembly which securely mounts on an aerosol can to provide protection for the valve, which is relatively difficult to open by children, and which is relatively inexpensive to manufacture and assemble.

OBJECTS OF THE INVENTION

With the foregoing in mind, a primary object of the present invention is to provide an improved overcap assembly for aerosol containers.

It is another object of the present invention to provide for an aerosol container an overcap assembly which is securely fastened thereto but which can be opened relatively readily by adults.

Another object of the present invention is to provide for an aerosol container an overcap assembly which overcomes the disadvantages of known aerosol overcaps.

SUMMARY OF THE INVENTION

More specifically, the present invention provides a two-part overcap assembly for use on a container having an end with an annular bead. The overcap assembly comprises a cup-shaped cap having an end wall and a depending side wall adapted to be positioned over the end of the container. Means carried by the cap intermediate its end wall and the container provides a pair of legs each having lugs releasably engaging beneath the bead on the container and diverging in an upward direction from the bead. The legs are connected together by webs located closer to the cap end wall than to the container to provide fulcrums for the legs. Threaded means on the cap and sleeve above the fulcrum cooperate when the cap is rotated to apply inward pressure to the legs above the fulcrum to move the lower portions of the legs outwardly for disengaging their lugs from beneath the container bead.

Preferably, the legs are provided by a tubular sleeve having an inverted frusto-conical shape with the lugs being located on the smaller lower end of the sleeve. The sleeve has slots which extend axially at diametrical locations in endwise alignment and terminate across webs at the fulcrum to define the legs. The threaded means is provided by a helical groove in the sleeve and a rib in a cylindrical wall which depends from the end wall of the cap. A series of reinforcing webs is also provided between the side wall of the cap and the cylindrical wall to reinforce the same. Preferably, the lugs and the bead are designed normally to rotate relative to one another but to require a combined turning and pulling action on the cap to disengage the cap and sleeve from the container.

BRIEF DESCRIPTION OF THE DRAWINGS

These and other objects, features and advantages of the present invention should become apparent from the following description when taken in conjunction with the accompanying drawings, in which.

DESCRIPTION OF THE PREFERRED EMBODIMENT

Figure 1:
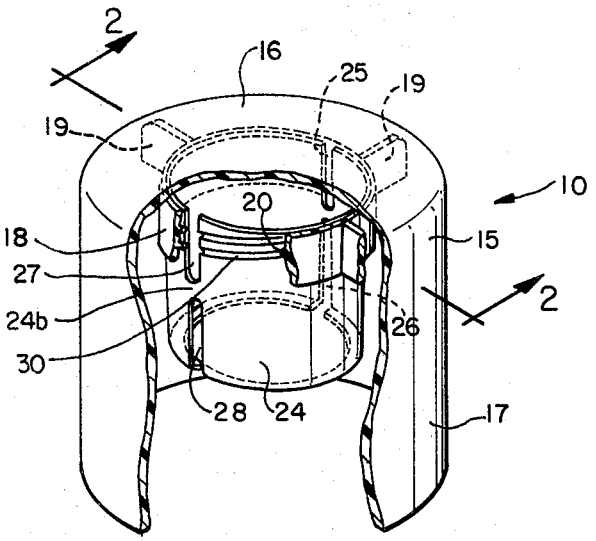
FIG. 1 is a perspective view of an overcap assembly embodying the present invention, portions having been broken away to expose interior details.
Figure 2:
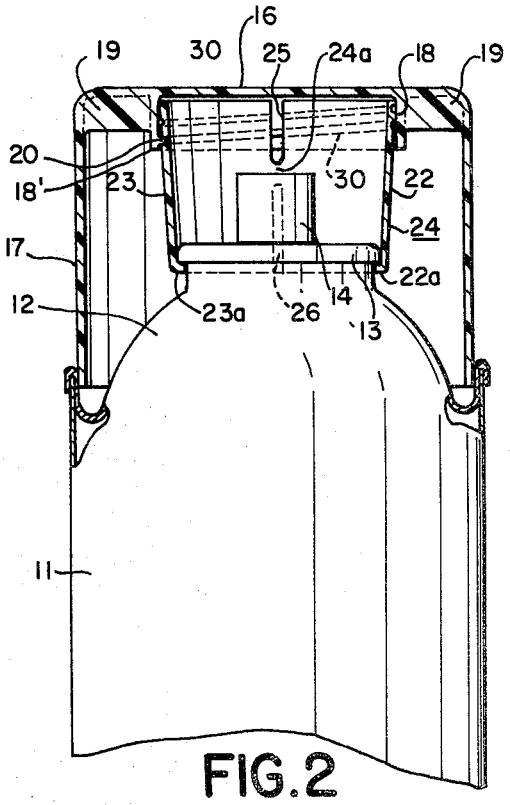
FIG. 2 is a sectional view taken line 2—2 of FIG. 1 and illustrating the overcap assembly mounted on an aerosol can.

Referring now to the drawings, FIG. 1 illustrates an overcap assembly 10 which embodies the present invention. The overcap assembly 10 is designed to be used in conjunction with valved aerosol containers to protect the valve during shipment. A typical container or can is illustrated in FIG. 2 and comprise a body 11 having a domed upper end 12 which terminates in an annular bead or finish 13. The container 11 normally contains liquids under pressure which are released from the container body 11 by a press-type valve actuator 14.

Referring now to FIG. 1, the overcap assembly 10 comprises essentially two pieces. One piece is a cup-shaped cap member 15 having a circular end wall 16 and a depending tubular side wall 17. A relatively short cylindrical tubular wall 18 depends from the inside of the end wall 16 of the cap 15 for a relatively short distance, considerably shorter than the sidewall 17. A series of reinforcing webs 19 extend radially between the tubular wall 18 and the sidewall 17 of the cap 15. For purposes to be described, a helical bead 20 projects inwardly from the inside of the cylindrical wall 18 and makes one complete revolution beginning from a location 18' adjacent the lowermost terminus of the tubular wall 18. See FIG. 2.

For the purpose of releasably securing the cap 15 on top of the can 11, means providing a pair of legs 22 and 23 extends between the end wall 16 of the cap 15 and the domed upper end 12 of the container 11. In the illustrated embodiment, the pair of legs 22 and 23 are provided by a frusto-conical tubular sleeve 24 disposed in the cap 15 with its upper or large end adjacent the underside of the end wall 16 of the cap 15. The legs are defined in the sleeve 24 by means of a pair of slots 25 and 26 which extend inwardly from opposite ends of the sleeve 24, the slot 25 extending downwardly from the large upper end of the sleeve 24 and the slot 26 extending upwardly from the smaller narrow end. A like pair of slots 27 and 28 are similarly formed and located diametrically opposite the first mentioned pair of slots 25 and 26. Thus, the diametrically-disposed pairs of slots define the legs 22 and 23 in the sleeve 24.

The legs 22 and 23 are capable of flexing relative to one another. To this end, each pair of slots 25, 26 and 27, 28 terminates on opposite sides of web **24*a* and 24*b*, respectively of the material forming the wall of the sleeve 24. The webs 24*a* and 24*b* are sufficiently flexible to enable the lower ends of the legs 22 and 23 to be moved outwardly when the upper ends thereof are squeezed inwardly. Preferably, the slots are dimensioned so that the webs 24*a* and 24*b* are located closer to the upper end of the sleeve 24 than to the lower end thereof. As a result, a leverage action is provided, whereby a smaller inward movement at the upper end of the sleeve 24 causes the lugs 22*a* and 23*a*** thereof at the lower end thereof to move outwardly a relatively greater distance.

Figure 3:
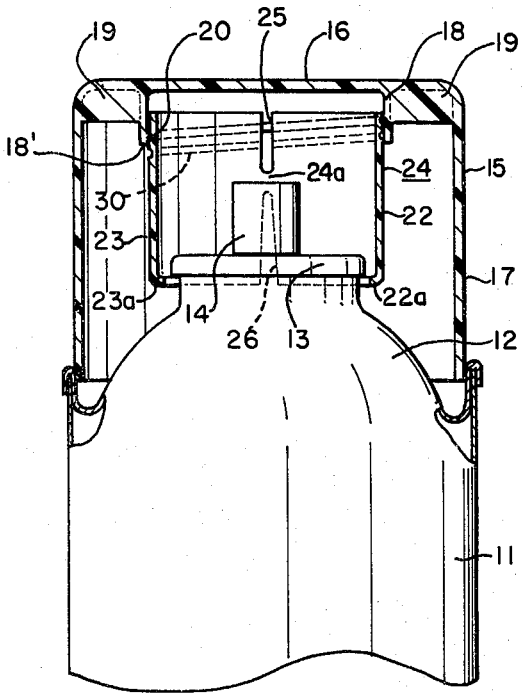
FIG. 3 is a sectional view similar to FIG. 2 but illustrating the overcap assembly partially disengaged from the aerosol can.

For the purpose of squeezing the upper end of the sleeve inwardly to enable the valve 14 on the container 11 to be exposed, a helical groove 30 is provided in the outer periphery of the sleeve 24. See FIG. 1. The groove 30, unlike the bead 20, extends from its origin adjacent the bead at the lower terminus 18' all the way to the top of the sleeve 24, making one and one half revolutions. As a result, counterclockwise rotation of the cap 15 relative to the sleeve 24 causes the bead 20 to advance along the groove 30 and thereby to displace the upper end of the sleeve 24 inwardly as the cap 15 rotates. Inward displacement of the upper end of the sleeve 24 is accommodated by the narrowing of the upper ends of the slots 25 and 27. The outward movement of the lugs **22*a* and 23*a* at the bottom of the sleeve 24 is accommodated by the lower slots 26 and 28 which tend to increase in width. See FIG. 3. By virtue of this structure, the lugs 22*a* and 23*a* are moved outwardly a sufficient distance to enable them to clear the bead 13 on the dome 12 of the container 11 before the cap 15 disengages the sleeve 24. As a result, the cap 15 and sleeve 24 can be removed as a unit to expose the valve actuator 14**.

While the pressure between the legs **22*a* and 23*a* and the can bead 13 can be designed to hold the sleeve 24 against rotation relative to the bead 13 during rotation of the cap 15, preferably the pressure is adjusted to allow the sleeve 24 to rotate with the cap 15 relative to the can bead 13. However, pressure between the lugs 22*a* and 23*a* and the can bead can be readily increased simply by pulling upwardly on the cap 15 during rotation of the cap 15 relative to the can 11. The pressure thereby increases the friction between the lugs 22*a* and 23*a* and the can bead 13 to cause the sleeve 24 to remain stationary relative to the can bead 13 so that the cap 15 can be rotated relative to the sleeve 24 as described heretofore. This structure thereby provides a child-proof function since it requires a combined rotary and axial pulling movement to remove the cap 15 and sleeve 24 to expose the valve 14. Of course, the friction between the lugs 22*a* and 23*a* and the can bead 13 may be varied in a number of ways, including provided a roughened surface or ribs on the tops of the lugs 22*a* and 23*a* and/or corresponding serrations or detents on the underside of the can bead 13**.

The cap 15 and sleeve 24 are capable of being installed on an aerosol container 11 by high-speed capping machinery. To this end, the sleeve 24 and cap 15 are preassembled in the configuration illustrated in FIG. 1, and the preassembled overcap assembly is fed into a capping machine which forces the overcap assembly downwardly over the bead 13 to seat as in FIG. 2. Preferably, the sleeve 24 is fabricated of a polyethylene plastic material which has a sufficient memory as to resume its normally contracted configuration after it has been thus installed. This thereby prevents the cap from being removed from the can 11 by pulling on it axially.

Since the lugs **22*a* and 23*a* are spread apart in the course of removing the overcap assembly 10, the overcap assembly 15 can be replaced on the container 11 without a subsequent turning action. This is because there is a slight deformation in the curvature of the lugs 22*a* and 23*a* when spread which provides a slight snapping action between the lugs and the bead 13. After the overcap assembly has been removed by the purchaser, the assembly can be reinstalled on the container 11 and held securely, albeit loosely in place. In the event, however, that the purchaser wishes to reestablish the child-proof function, he can simply screw the sleeve 24 clockwise relative to the cap 15 and cause it to resume the position illustrated in FIG. 2 and, by applying a substantial downward pressure on the cap 15, can mount the overcap assembly on the container in the manner illustrated in FIG. 2. As noted above, the inherent elastic memory of the plastic of the sleeve 24, over a period of time, causes the lugs 22***a* and 23*a* to engage under the bead 13 to preclude easy removal.

In view of the foregoing, it should be apparent that the present invention now provides an improved overcap assembly for aerosol containers.

While a preferred embodiment of the present invention has been described in detail, various modifications, alterations and changes may be made without departing from the spirit and scope of the invention as defined in the appended claims.

I claim:

1. For a container having an end with an annular bead, an overcap assembly, comprising:

a cup-shaped cap member having an end wall adapted to overlie said container end and a sidewall depending from said end wall, means carried by said cap intermediate its end wall and said container providing at least a pair of legs, said legs having lugs releasably engaging beneath said container bead and diverging in an upward direction from said bead, means connecting said legs together intermediate said cap end wall and said container bead to provide a fulcrum for said legs, means in said cap threadly engaging said legs above said fulcrum for applying inward pressure to said legs above their fulcrums as the cap rotates to cause the lugs to disengage said container bead to afford removal of said cap from said container.

2. An assembly according to claim 1 wherein said leg providing means includes a tubular sleeve having a frusto-conical shape disposed in said cap with its large end confronting the end wall of the cap and said lugs being located on the small end.

3. An assembly according to claim 2 wherein said sleeve has slot means extending inwardly from opposite sleeve ends at diametrical locations and terminating defining the legs and forming closer to the large end than the small end for flexible fulcrum for said legs.

4. An assembly according to claim 3 wherein said slot means includes a pair of endwise aligned relatively narrow slots.

5. An assembly according to claim 4 wherein said threaded means includes a helical groove in said sleeve and a rib engaging in said groove.

6. An assembly according to claim 5 including a tubular wall depending from the end wall of said cap and formed integral therewith, said wall circumscribing the large end of said sleeve.

7. An assembly according to claim 6 wherein said tubular wall is continuous and has a terminus a spaced distance inwardly of the cap end wall with said rib being located adjacent its terminus.

8. An assembly according to claim 7 wherein the large end of the sleeve is normally disposed closely adjacent the inside of the endwall of said cap.

9. An assembly according to claim 7 including a series of reinforcing webs extending at spaced intervals between the sidewall of the cap and said tubular wall.

10. An assembly according to claim 1 wherein said lugs normally rotatably engage said bead so that both a pulling and rotating motion must be applied to the cap to cause the lugs to remain stationary with respect to the bead so that the cap can be rotated relative to the sleeve.

* * * * *